United States Patent [19]

Suissa

[11] Patent Number: 4,520,577

[45] Date of Patent: Jun. 4, 1985

[54] CLEANING APPARATUS

[76] Inventor: Moshe Suissa, 5561 Alpine Ave., Cote St. Luc, Montreal, Quebec, Canada

[21] Appl. No.: 482,088

[22] Filed: Apr. 4, 1983

[30] Foreign Application Priority Data

Apr. 2, 1982 [CA] Canada ..... 400389

[51] Int. Cl.[3] ..... F26B 11/04

[52] U.S. Cl. ..... 34/76; 34/77; 68/18 C; 62/238.7; 62/324.1

[58] Field of Search ..... 62/90, 176.5, 196.4, 62/238.7, 324.1; 68/18 C; 34/77, 76, 63, 48

[56] References Cited

U.S. PATENT DOCUMENTS

| | | | |
|---|---|---|---|
| 4,262,430 | 4/1981 | Janson et al. | 34/77 |
| 4,365,480 | 12/1982 | Darm | 62/278 |
| 4,370,816 | 2/1983 | Zambelli | 34/77 |

FOREIGN PATENT DOCUMENTS

| | | |
|---|---|---|
| 346490 | 12/1934 | Canada . |
| 347759 | 1/1935 | Canada . |
| 365624 | of 1937 | Canada . |
| 509378 | 1/1955 | Canada . |
| 632458 | 12/1961 | Canada . |
| 733727 | 5/1965 | Canada . |
| 739683 | 8/1966 | Canada . |
| 1033964 | 7/1978 | Canada . |

*Primary Examiner*—Larry I. Schwartz

*Attorney, Agent, or Firm*—Sughrue, Mion, Zinn, Macpeak and Seas

[57] ABSTRACT

There is described an apparatus for drying and cooling dry cleaned items and for recovering cleaning solvents therefrom, including a cleaning drum for receiving and treating the items with cleaning solvent, a circulating fan for drawing air through the drum, a heater for heating the air drawn through the drum during the drying cycle of the dry cleaning machine, a condenser for condensing solvent vapors entrained in the heated air during the drying cycle and a gas compresser to supply the heater and condenser with hot gas during the drying cycle of the apparatus. The compresser also supplies cold refrigerant to the condenser during the drying cycle. The compresser then supplies cold refrigerant both to the heater and the condenser during the cooling cycle of the apparatus.

6 Claims, 3 Drawing Figures

CLEANING APPARATUS

The present invention relates to a cleaning apparatus and method and more particularly to a dry cleaning apparatus for cleaning fabrics, textiles and other materials using organic solvents such as chlorinated hydrocarbons or any other solvents.

Numerous dry cleaning machines have of course been developed over the years although the basic and underlying concepts have remained substantially the same even to the present day. The cleaning operation involves agitating clothing or other items in a bath of organic solvents supplied from a reservoir. The soiled solvent is filtered to remove ditritus and then purified by means of distillation. To this end, the soiled solvent is vaporized in a still or evaporator, the vapors are condensed and the purified solvent is returned to the solvent reservoir after any entrained water has been decanted off.

To dry the clothing, the clothing drum is drained of solvent and the clothing is usually centrifuged to remove excess solvent. Air hot enough to volatilize the remaining entrained solvents is drawn through the drum by means of a circulating fan. The solvent vapors are drawn into a condenser and condensed. The condensate is drained off to a decanter which separates water from the solvent, the recovered solvent being returned to the solvent reservoir. The air drawn through the condenser is circulated by the fan through a heater which reheats the air prior to reintroduction into the drum. This cycle is continued until practically all of the entrained solvents have been recovered from the clothing.

In practically all commercially available dry cleaning machines, the condenser must be supplied with water as the cooling medium whereas a source of steam or hot water is required to heat the circulating air. It will be appreciated therefore that the drying cycle is energy intensive, adding substantially to dry cleaning costs.

A final deodorizing cycle usually follows the drying cycle. A damper is activated so that the heater is bypassed and fresh air is drawn into the drum by the fan. The remaining solvent vapors and odors are then exhausted into the environment. The fumes exhausted are detrimental to the environment and are noxious to those encountering them, particularly the machine operator.

The present invention concerns improvements to the drying and deodorizing cycle of a dry cleaning apparatus and has as its object the provision of a more energy efficient and ecologically suitable apparatus which obviates and mitigates from the disadvantages of prior dry cleaning machines.

Generally, it has been found that if the condenser and heater are both used for heating during the drying cycle and then are both used for cooling during the cooling and deodorizing cycle, substantial energy and other cost savings are achieved. Further, the system may be entirely closed, eliminating external exhausts. Additional advantages and efficiencies will become more apparent from the detailed description following hereinafter.

Embodiments of the invention will now be described in greater detail and will be better understood when read in conjunction with the following drawings in which.

The following description of an exemplary embodiment is made with respect to that part of a dry cleaning apparatus utilized to dry and deodorize cleaned clothes. Most dry cleaning machines include of course suitable apparatus well known to those skilled in the art for cleaning the clothes and recovering and purifying the cleaning solvents. These portions of dry cleaning machines form no part of the present invention and no further description thereof is provided herein.

Figure 1:
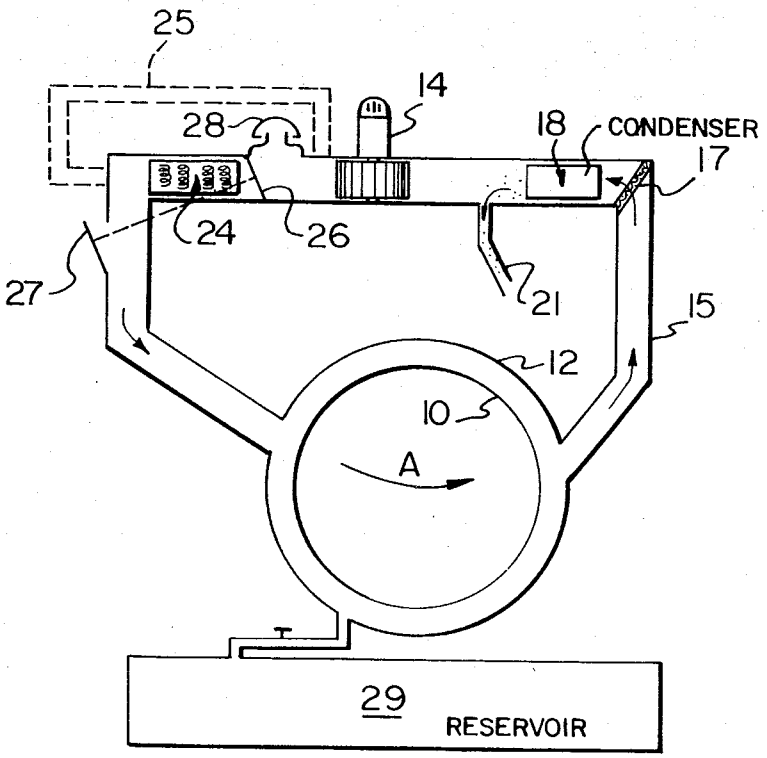
FIG. 1 is a schematical representation of part of dry cleaning apparatus as described hereinafter.

Referring now to FIG. 1, there is shown schematically that part of a conventional dry cleaning machine relating to the drying and deodorizing function. The actual hardware is all conventional and well known in the art and will not therefor be described in great detail herein.

Clothing is cleaned within perforated drum 10 which revolves within a cylindrical casing 12 to work the clothing within a bath of cleaning solvent such as perchlorethylene or trichlorethylene. Upon completion of the cleaning cycle, the solvent is drained from casing 12 by means not shown but which are conventional and well known and the drum 10 is rotated rapidly to centrifuge excess solvents from the clothing. The excess solvents so recovered are removed from casing 12 as well.

Because of the high cost of solvent, it is desirable to reclaim the solvents remaining within the clothing. This is done by heating the clothing to volatilize the adhering solvents, condensing the vapors so formed and returning the condensate to the solvent reservoir.

Referring once again to FIG. 1, a fan 14 is utilized to draw air from casing 12 through duct 15 to condenser 18. A lint filter 17 is provided adjacent the intake of condenser 18 to remove particulate and other airborne ditritus. The solvent vapors condensed by condenser 18 are drained off via conduit 21 to a decanter (not shown) of conventional design wherein entrained moisture is separated from the solvent. Purified solvents from the decanter are returned to the reservoir. The discharge side of fan 14 communicates with heater 24 which reheats the air prior to re-entry into casing 12. The cycle of air in the direction indicated by arrow A continues until the flow of solvent through conduit 21 ceases.

Even after the drying operation is completed, residual amounts of solvent remain in the clothing and it is therefore necessary to cool and deodorize them. Typically, this is accomplished by activating a damper 26 to seal off heater 24, at the same time opening a gate of flue 27 downstream of the heater to allow fresh air to be drawn by means of fan 14 through gate 27. The fresh air is circulated through casing 12 and is exhausted out duct 15 into the atmosphere via a vent 28. A common alternative to this arrangement requires the use of a bypass duct 25 shown in dotted lines wherein the air is continuously circulated through the system until deodorization is complete.

Typically, the cooling medium to condenser 18 is water. The most commonly used heating medium to heater 24 is steam so that the temperature of the circulating air may be sufficiently elevated to vaporize entrained solvents. It will be appreciated that substantial amounts of energy are required for the drying cycle in that there must be provision for steam generation. Moreover, the temperature drop across condenser 18 is substantial, requiring that large amounts of energy be supplied to heater 24 to ensure adequate temperature generation and heat formation.

It will be further appreciated that large amounts of water are required, adding to the costs of the drying cycle not only in terms of the actual amounts of water circulated through condenser 18 but also in view of the concomitant sewerage charges levied by most municipalities on the basis of rates of water consumption.

To overcome the foregoing disadvantages of prior systems such as described above, it has been found that major economies can be achieved by utilizing refrigeration apparatus to simultaneously supply heat to each of condenser 18 and heater 24 during the drying cycle and cold to each of these elements during the cooling and deodorizing cycle. As a result, no steam nor exhaust is required, and only relatively small amounts of water are required. More importantly, the energy consumption of the unit as a whole is substantially reduced.

Figure 2:
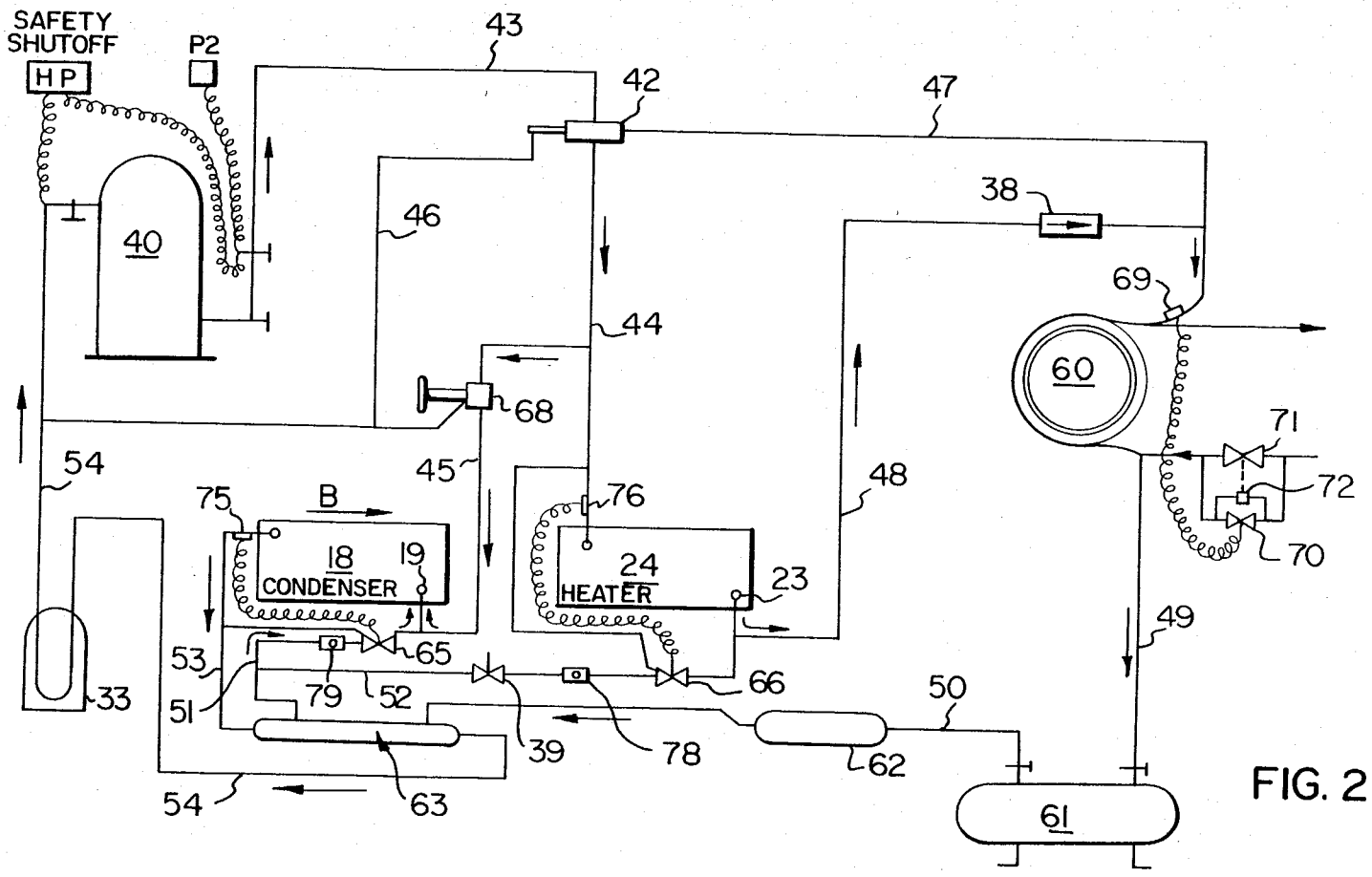
FIG. 2 is a schematical representation of part of the present dry cleaning apparatus as described hereinafter with reference to the drying cycle thereof.

Referring now to FIG. 2, the operation of the present apparatus during the heating or drying cycle is schematically illustrated. Again, the actual hardware used is conventional and quite familiar to those skilled in the art such that a full and detailed description thereof has been omitted. Like reference numerals have been used to designate like elements. The solid lines interconnecting various components of the apparatus represent conduits for a refrigerant such as trichlorofluoromethane, more commonly referred to as freon.

As in conventional apparatus, a fan, not shown, is used to continuously circulate air through the cleaning drum, condenser 18 and heater 24 in the direction indicated by arrow B. Freon gas is compressed by compresser 40 to generate heat which is transmitted to heater 24 via conduits 43 and 44. Reclaim valve 42 is programmed to close conduits 46 and 47 during the drying cycle. Similarly, solenoid valve 39 is also closed during the drying cycle, directing the flow of heated gas through conduit 48 and one-way check valve 38. From valve 38, the freon enters conduit 49 (conduit 47 being blocked by reclaim valve 42) and passes through supplementary condenser 60 to reservoir 61 as a liquid.

At startup, little if any water need be supplied to condenser 60 to cause condensation of the refrigerant; there being sufficient heat loss in the freon to result in condensation thereof. It will be appreciated that condensation of some freon is required to avoid over pressuring the entire system. With time, however, sufficient heat builds up requiring that some water be supplied to the condenser. A sensor 69 is provided as shown to sense the incoming temperature of the freon. As the incoming temperature increase, valve 70 is actuated by degrees to allow small but increasing amounts of water to pass through condenser 60. This ensures the condensation of sufficient, empirically determined amounts of freon to maintain a range of predetermined pressures throughout the system. In the event that sensor 69 or valve 70 fail, a safety bypass 71 is tripped by sensor valve 72 to allow water to course through condenser 60.

From reservoir 61, liquid freon travels along conduit 50 through dryer 62 which removes residual moisture, through heat exchanger 63 and thence into conduit 51. As mentioned previously, solenoid 39 is closed, preventing passage of the freon through conduit 52. The freon is atomized and thereby cooled by passage through expansion valve 65 whereupon it enters condenser 18 at 19 to cause condensation of the solvent laden vapors passing therethrough.

The emergent temperature of the freon from expansion valve 65 may be as low as −10° F. which is far below the temperature actually required to cause condensation of the solvent. It has been found that satisfactory rates of condensation can be achieved at approximately 85° F. Accordingly, to elevate the temperature of the freon entering condenser 18, a quantity of hot gas, the flow of which is regulated and modulated by regulator valve 68, is supplied to condenser 18 via conduit 45. The hot gas and atomized freon blend to elevate the temperature of the refrigerant prior to circulation through condenser 18.

During the drying cycle, the hot gas elevates the temperature of heater 24 to approximately 140° F. It will be appreciated that because of the reduced temperature differential between condenser 18 and heater 24, this temperature is adequate to ensure the flow of sufficiently heated air to casing 12 to cause volatilization of the solvents entrained in the clothing. Obviously, as less heat need be supplied to the heater, less energy is required to generate that heat. It follows that a smaller compresser than would otherwise be required if a large temperature differential were maintained between the heater and condenser may be utilized and that such compressor may be operated at peak rates of efficiency.

From condenser 18, the refrigerant passes through conduit 53, heat exchanger 63 and conduit 54 to complete the loop with gas compresser 40. An accumulator 33 of any known, suitable variety is provided in conduit 54 to prevent transmission of any liquid to compresser 40.

Figure 3:
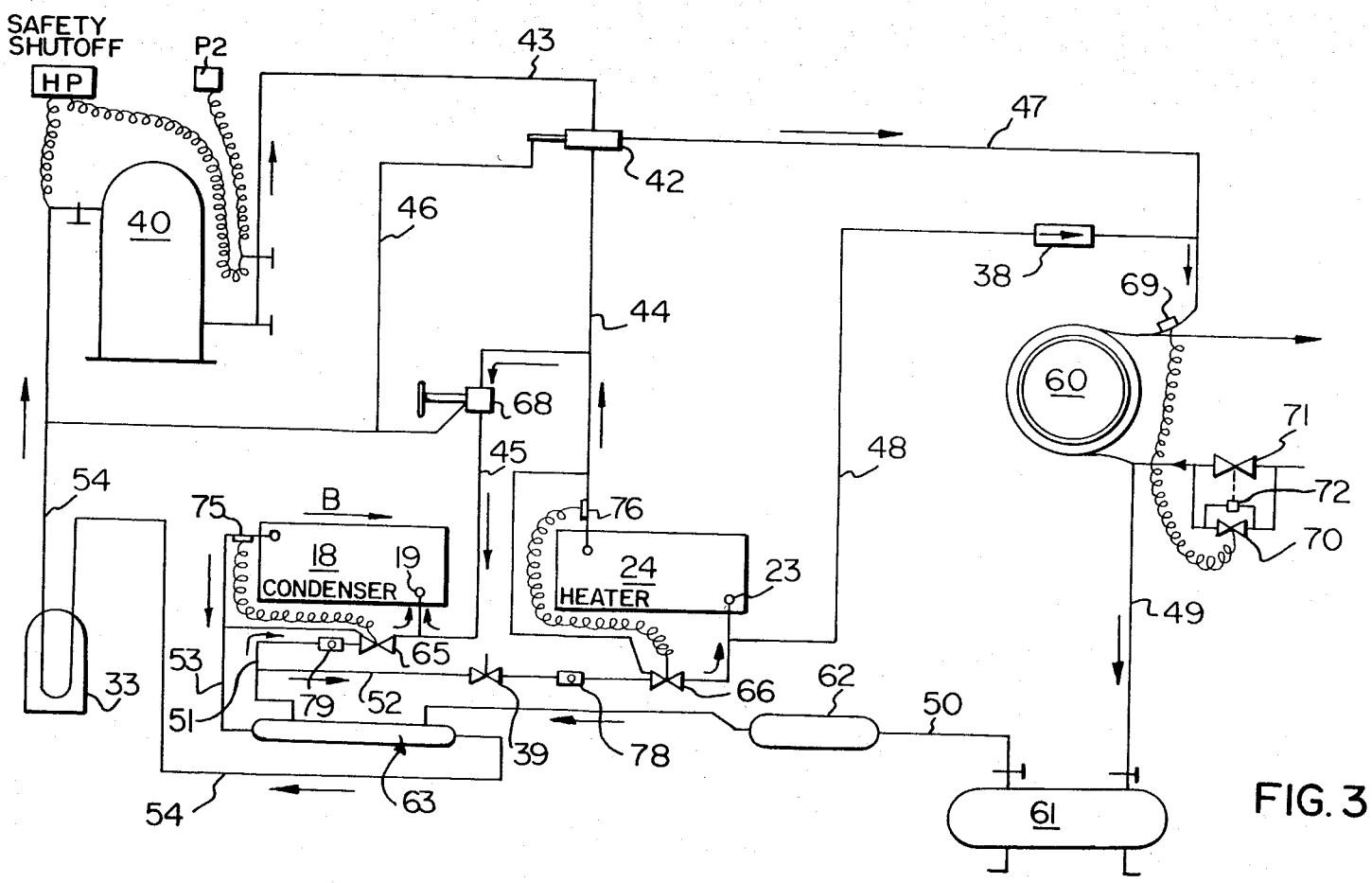
FIG. 3 is a further schematical representation of a part of the present dry cleaning apparatus as described hereinafter with reference to the cooling and deodorizing cycle thereof.

Approximately 95% of entrained solvents can be recovered by the drying process. Thereafter, the clothes must be cooled and deodorized prior to removal from the machine. Reference will now be made to FIG. 3 with respect to the cooling and deodorizing cycle of the present apparatus. The flow of refrigerant during the cooling cycle is shown by the arrows.

As will be observed, reclaim valve 42 is actuated to open conduit 47 and close conduit 44. Simultaneously, solenoid valve 39 is also opened to allow the flow of refrigerant to enter heater 24 at 23 after passing through expansion valve 66.

Following the arrows, hot gas flows through conduits 43 and 47, through condenser 60 wherein it is condensed and thence as a liquid through conduit 49 to reservoir 61. From reservoir 61, the flow of liquid refrigerant is substantially as described above with respect to the drying cycle until the intersection of conduits 51 and 52 is reached. At this point, the flow of refrigerant is bifurcated although because of the greater suction across expansion valve 65 relative to expansion valve 66, a larger flow of refrigerant is directed towards condenser 18. The opening and hence the suction across expansion valves 65 and 66 is regulated by sensors 75 and 76, respectively, which monitor the temperature of the emerging freon from the condenser and the heater to cause either more or less suction across the valves associated therewith.

As mentioned above, check valve 38 is actuatable to allow flow in the direction of the arrow only. Valve 38 is therefore maintained in a closed position by the gas pressure in conduit 47 to prevent the passage of gas from conduit 47 into conduit 48. Similarly, the flow of refrigerant from conduit 48 into conduit 52 is also prevented.

It will be appreciated that during the cooling cycle, the flow of refrigerant through heater 44 is reversed in direction relative to that occurring during the drying cycle. Rather than hot gas being supplied to the heater, cold refrigerant enters the heater at 23 to quickly chase the heat therefrom. The refrigerant passes through heater 24 to condenser 18 via conduits 44 and 45. From condenser 18, the flow of refrigerant to compresser 40 is substantially the same as that described above with respect to the drying cycle.

In operation, the fan circulated air flowing in the direction of arrow B is sufficiently chilled when passing through condenser 18 to cause freezing of the residual solvent vapors. Heater 24, instead of being bypassed, is utilized to augment the cooling process such that the two coils working in tandem achieve energy efficiencies and eliminate the need to provide a heater bypass damper or conduit. Freezing of the residual solvents prevents their return to the clothing so that the clothes are effectively cooled and deodorized without the need to exhaust the circulated air to the external environment.

A corollary advantage achieved by virtue of the cooling cycle is that ambient air is drawn into the drum when it is opened to remove the clothing, further minimizing the operator's exposure to noxious fumes. It will be appreciated that if the drum were opened when hot, the flow of air and fumes would be outwardly into the relatively cool environment of the room housing the dry cleaning apparatus.

It will be appreciated from the foregoing that both heating and cooling are accomplished by refrigeration means including a single, relatively small, compresser. Embodiments of the present invention constructed by the applicant have been found to consume as little as one quarter of the water required by more conventional machines now in use. Furthermore, energy savings have been experienced in the order of 30 percent of regular rates of consumption.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. An apparatus for performing drying and cooling cycles on dry cleaned items and for recovering cleaning solvents therefrom, including:

drum means for receiving said items for treatment with cleaning solvent;

circulating means for drawing air through said drum means following said treatment;

condensing means for condensing solvent vapors entrained in said heated air during said drying cycle;

heater means for heating the air drawn through said drum means during the drying cycle of said apparatus; and gas compresser means to supply cold refrigerant and hot gas to said condensing means and hot gas to said heater means during said drying cycle; and cold refrigerant to said heater and condensing means during said cooling cycle of said apparatus.

2. The apparatus of claim 1 further including regulator means to control the flow of hot gas to said condensing means during said drying cycle.

3. The apparatus of claim 2 wherein the flow of hot gas to said condensing means during said drying cycle is regulated to maintain the temperature of said condensing means in a range between 60° and 90° F.

4. The apparatus of claim 3 wherein the temperature of said condensing means is maintained at approximately 85° F. during said drying cycle.

5. The apparatus of claim 1 wherein said circulating means include fan means, the intake end of which communicates with said condensing means and the discharge end of which communicates with said heater means to draw air through said condensing means and then to force said air through said heater means.

6. The apparatus of claim 5 wherein said heater means and condensing means include sensor means to determine the temperature of the refrigerant emerging therefrom, said sensor means communicating with expansion valve means actuatable in response to said sensor means to regulate the flow of refrigerant through said heater and condensing means, respectively.

* * * * *